US005752812A

United States Patent [19]

Brown

[11] Patent Number: 5,752,812

[45] **Date of Patent: *May 19, 1998**

[54] VAPOR RECOVERY PUMP

[75] Inventor: Stephen C. Brown, Kentwood, Mich.

[73] Assignee: Delaware Capital Formation, Inc., Wilmington, Del.

[ * ] Notice: The term of this patent shall not extend beyond the expiration date of Pat. No. 5,591,019.

[21] Appl. No.: 712,776

[22] Filed: Sep. 12, 1996

Related U.S. Application Data

[63] Continuation of Ser. No. 608,573, Feb. 28, 1996, Pat. No. 5,591,019.

[51] Int. Cl.[6] ..... F04B 35/04

[52] U.S. Cl. ..... 417/422

[58] Field of Search ..... 417/410.1, 410.3, 417/422, 423.7

[56] References Cited

U.S. PATENT DOCUMENTS 2,346,398 4/1944 Rohr et al. ..... 417/410.1 X
3,212,449 10/1965 Whalen et al. ..... 417/410.1 X
3,829,248 8/1974 Bright et al. ..... 417/410.3
4,846,635 7/1989 Fry et al. ..... 417/410.1
5,360,322 11/1994 Henein et al. ..... 417/410.1 X
5,591,019 1/1997 Brown ..... 417/410.1 X

*Primary Examiner*—Richard E. Gluck
*Attorney, Agent, or Firm*—Flynn, Thiel, Boutell & Tanis, P.C.

[57] ABSTRACT

A vapor recovery pump for pumping flammable vapors is disclosed. The pump includes a pump unit that defines a pump chamber into which the vapor is first drawn and then exhausted from. A motor contained in a motor housing provides the motive force for energizing the pump unit. A single-piece inboard head seals the pump chamber and the motor housing and spaces the pump chamber away from the motor. Removable flame arrestor assemblies are attached to the inlet and outlet ports into which the vapor is, respectively, drawn into and exhausted from. A gland assembly integral with the motor housing provides a seal around the conductors that extend to the motor.

6 Claims, 9 Drawing Sheets

VAPOR RECOVERY PUMP

This is a continuation of Ser. No. 08/608,573, filed Feb. 28, 1996, now U.S. Pat. No. 5,591,019.

FIELD OF THE INVENTION

This invention relates generally to vapor recovery pumps and, more particularly, to vapor recovery pumps employed to pump volatile, flammable vapors such as those given off by petroleum fuels.

Background of the Invention

Vapor recovery pumps are employed in many commercial and industrial environments to draw gaseous-state fluids away from a first, source location to a second, destination location. One location where vapor recovery pumps are used is at a gasoline station. Here, vapor recovery pumps are used to recover the vaporized petroleum products discharged as a inevitable result of the filling of a vehicle's tank. FIG. 1 schematically shows a vapor recovery system 10 for preventing the loss of volatile, flammable vapor while delivering the fuel (e.g. gasoline, kerosene, or alcohol) F to the fill port FP of a powered vehicle PV. The system 10 includes a pump and meter unit P/M for pumping fuel from a storage tank ST (typically an underground storage tank) through a metering assembly (not shown) into a dual-line passage fuel/vapor hose 12. The hand held fuel controller C has a manually actuated fuel flow trigger T attached to the end of the hose controlling the discharge of the fuel from a fuel outlet N that is insertable into the vehicle fuel port FP.

Associated with the nozzle N and insertable therewith into the fuel port FP is a vapor pick up, schematically indicated at VPU. Vapor pick up VPU connects through a vapor return conduit 13 which extends through the center of hose 12. Vapor return conduit 13 is connected to a vapor recovery pump 11. This pump 11 may be located as shown near the top of the pump meter unit P/M or located near ground level adjacent the storage tank ST. Pump 11 draws a vacuum at vapor pick up VPU so as to draw vapor from the nozzle at the VPU port and return it back to the storage tank ST through return conduit 14. The system 10 is thus used to feed fuel from the storage tank ST while simultaneously recovering volatile vapors V and returning same to the storage tank ST or other storage container. System 10 thus prevents the release of such volatile vapors into the atmosphere. The capturing of these hydrocarbon vapors also allows them to be returned to the storage tank so that they can be used as fuel. Thus, vapor recover systems both minimize pollution and prevent the needless loss of vaporized fuel.

In some preferred forms of the vapor recovery system 10, it is desirable to provide an electrically actuated pump 11 for drawing requisite suction. Electrical pumps are often used in vapor recovery systems because they can be controlled to operate independently of the rate at which the fuel F is discharged by the system 10.

A prior art vapor pump 11 suitable for providing the requisite suction is now described in briefly with respect to FIGS. 2 and 3. This pump is the vapor recovery pump marketed by Blackmer of Grand Rapids, Michigan as Model No. VRG ¾. Pump 11 includes a motor 22 and a pump unit 24 which are assembled as a single unit. The motor 22, located inside a motor housing 26, provides the motive force needed to draw the desired suction. Pump unit 24 includes a sleeve-like cylinder 28 which defines a pumping chamber 30 in which the actual vacuum is formed. A motor rotor 32 has a shaft 34 which is driven by the stator of the motor 22 and a pump rotor 36 integrally attached thereto which is disposed inside the pumping chamber 30. Relative to the pump chamber 30, pump rotor 36 is mounted in an off-center position. Vanes, not illustrated, are fitted into slots defined in the pump rotor 36 so as to move laterally towards and away from the center axes of the motor rotor 32 during the rotation of the rotor. The vanes cooperate with the inner wall of cylinder 28 to define small vacuum chambers into which the vapor is drawn into the pump and then is exhausted therefrom.

Pumps, such as pump 11, have proved useful devices for drawing volatile fluids, such as gasoline, away from one location to a second, storage location. Nevertheless, there are several limitations associated with current pumps. Some of these limitations are associated with the fact that it has become increasingly desirable to design these pumps so that the motor 22 and pump unit 24 are, what are referred to as "explosion proof." Here, "explosion proof" means that if inside one of these units any flammable material is some how ignited, that the flames generated by the ignition will not travel outside of the unit where it could cause other flammable material to ignite. "Explosion proof" also means that if there is ignition of flammable material inside the unit, that there will be an exhaust path for the gases generated as a result of the combustion. Providing this exhaust path prevents pressure inside the unit from building up to the point where the unit will physically explode.

Moreover, in addition to making both the motor and pump unit of a vapor recovery pump explosion proof, there is an interest in positioning these units so that they are spaced a significant distance apart. This separation is desirable for preventing damage to either the motor or pump unit from causing a chain explosion of the complementary unit. Thus, in some countries, there is now a requirement that the motor and pump be spaced at least 10 mm apart.

To date, however, it has proven a difficult task to construct a vapor recovery pump with explosion proof motor and pump unit that are spaced apart from each other and that is further configured so that the pump is relatively small in size. Size is a factor in the design of these pumps because they are often located in spaces, such as in gasoline pumps, where the space to position such sub-assemblies is limited. Moreover, in the event the use of such pumps because mandatory, they must fit in the space occupied by current pumps which typically are not large in size.

Still another cause for concern associated with current vapor recovery pumps is associated with the sensors employed to motor the state of the motor. These sensors, magnetically-sensitive Hall effect sensors, have to be positioned precisely in the motor in order to monitor the state of the motor's rotor. Problems arise because during manufacture, the rotor may be positioned too far from the sensors for them to properly function. In other instances, the motor rotors have been fitted so that they physically abut and sometimes damage the sensor. Either manufacturing misalignment may result in a rotor that may not function properly. Thus, it has proven difficult to consistently manufacture these motors so that they have the proper spacing between their rotors and their associated Hall effect sensors.

Moreover, it has become increasingly desirable to provide vapor recovery pumps used to recover volatile substances with flame arrestors. A flame arrestor is a porus member formed out of nonflammable, thermally conductive material. The flame arrestors are located along the fluid path the vapor travels both in and out of the pump. In the event the vapor in the line extending to the pump ignites, the flame arrestors serves as heat sinks that prevent the flame from traveling downline to the location where the recovered vapors are stored. Moreover, in the event the vapor in the pump unit is ignited, the flame arrestors prevent the flame in the pump chamber from propagating.

Currently, vapor recovery pumps are designed so that flame arrestors are located in the pump head, one before and one immediately downstream of the pump chamber. A disadvantage of this arrangement is that over time the dust and particulate matter that is inevitably drawn into the pump clogs the flame arrestor. Once this occurs, the pump functions either inefficiently or, not at all. Therefore, in order to ensure the efficient operation of the pump, these flame arrestors are periodically cleaned or replaced. Problems arise because these flame arrestors are located so deep into the body of the pump head that, to access them for removal or installation when the pump is part of a gasoline pump becomes a difficult, time consuming task.

SUMMARY OF THE INVENTION

This invention relates to an improved vapor pump that has both an explosion proof motor housing and pump unit, that inhibits flame flow through the pump, that is relatively small in size, economical to manufacture and easy to maintain.

BRIEF DESCRIPTION OF THE DRAWINGS

This invention is pointed out with particularity in the claims. The above and further advantages of the invention may be better understood by referring the following description taken in conjunction with the accompanying drawings, in which:

DETAILED DESCRIPTION

Figure 1:
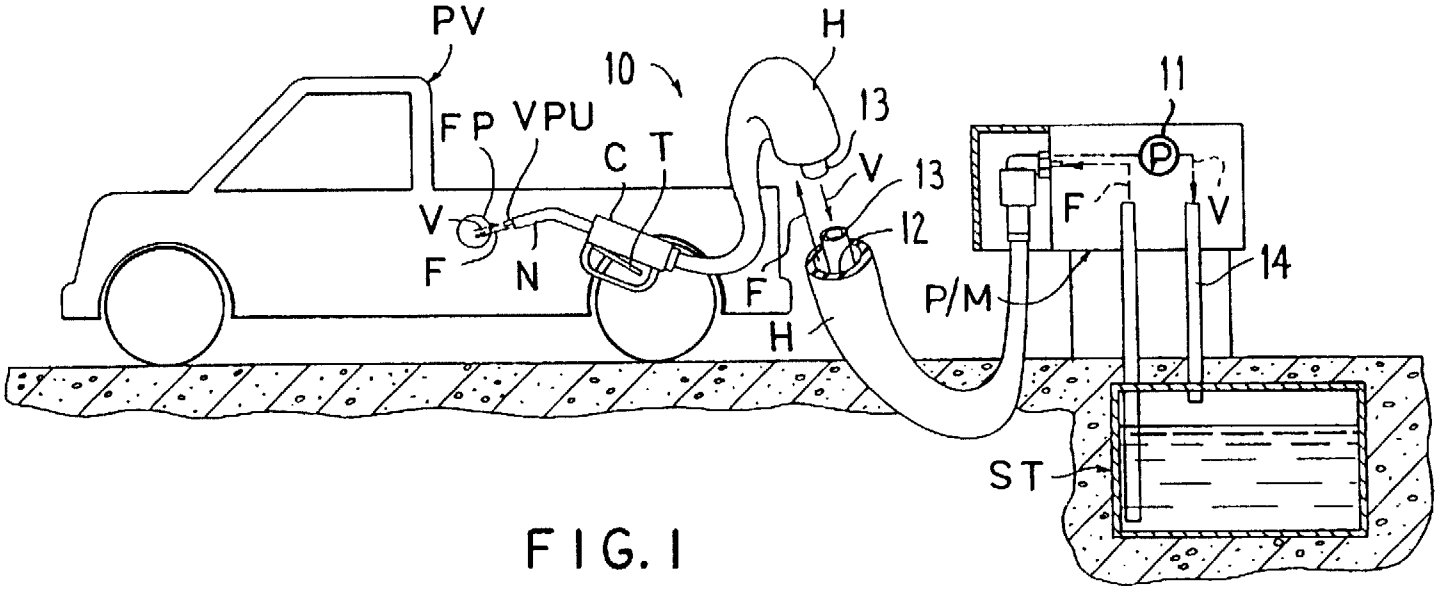
FIG. 1 is a diagrammatic illustration of a fluid pumping station which a vapor recovery pump of this invention may be employed.
Figure 2:
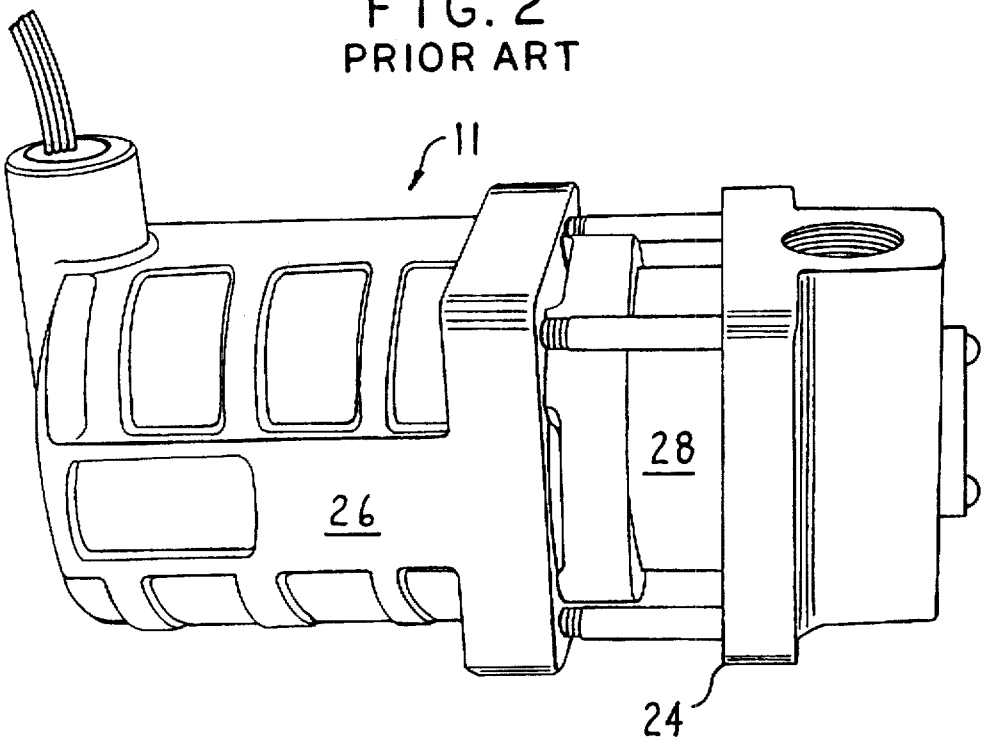
FIG. 2 PRIOR ART
FIG. 2 is a side view of a prior art vapor pump.
Figure 4:
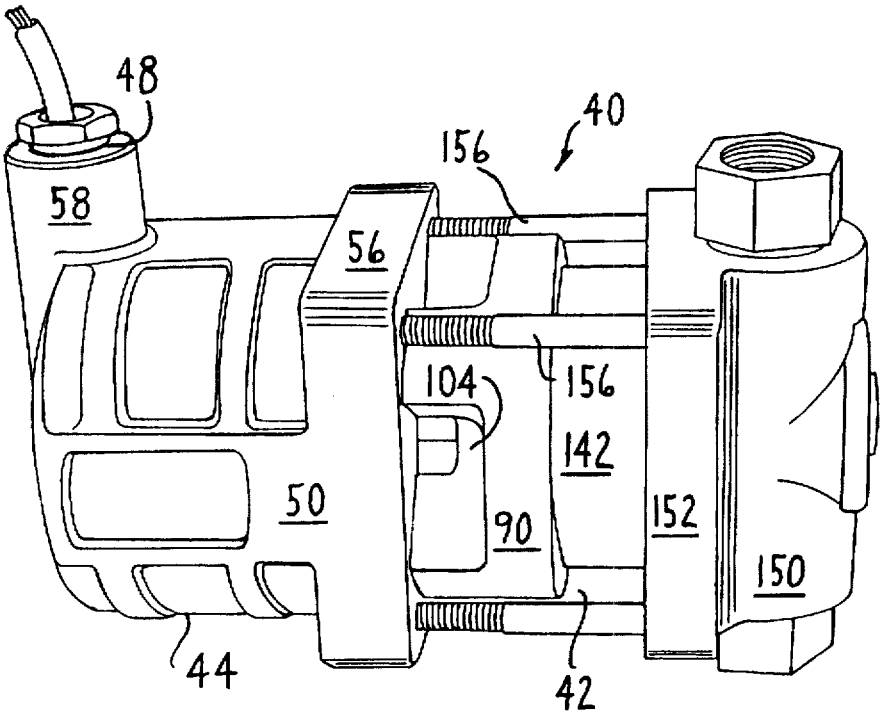
FIG. 4 is a side view of the vapor pump of this invention.
Figure 3:
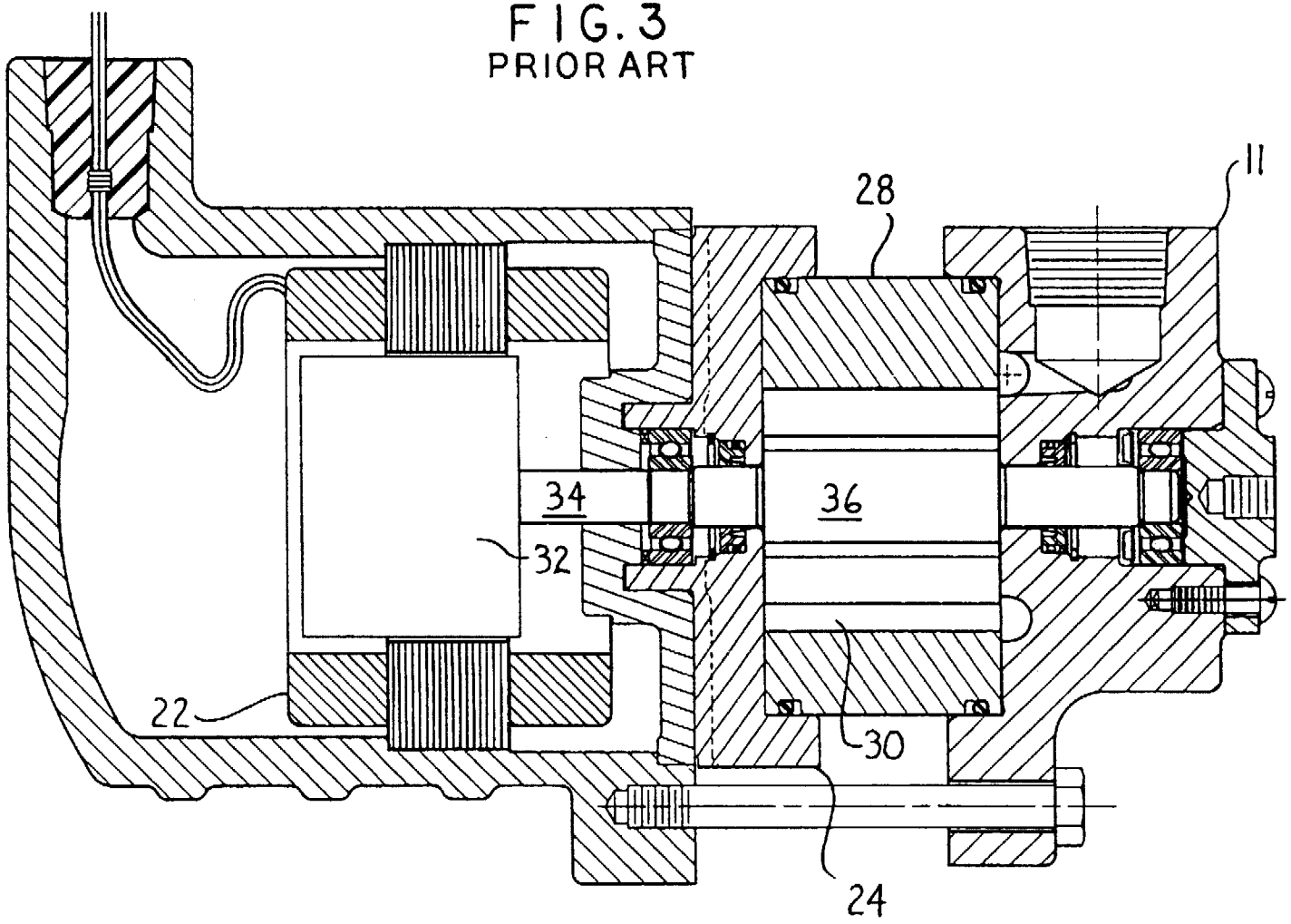
FIG. 3 PRIOR ART
FIG. 3 is a cross sectional view of the prior art pump of FIG. 2.
Figure 5:
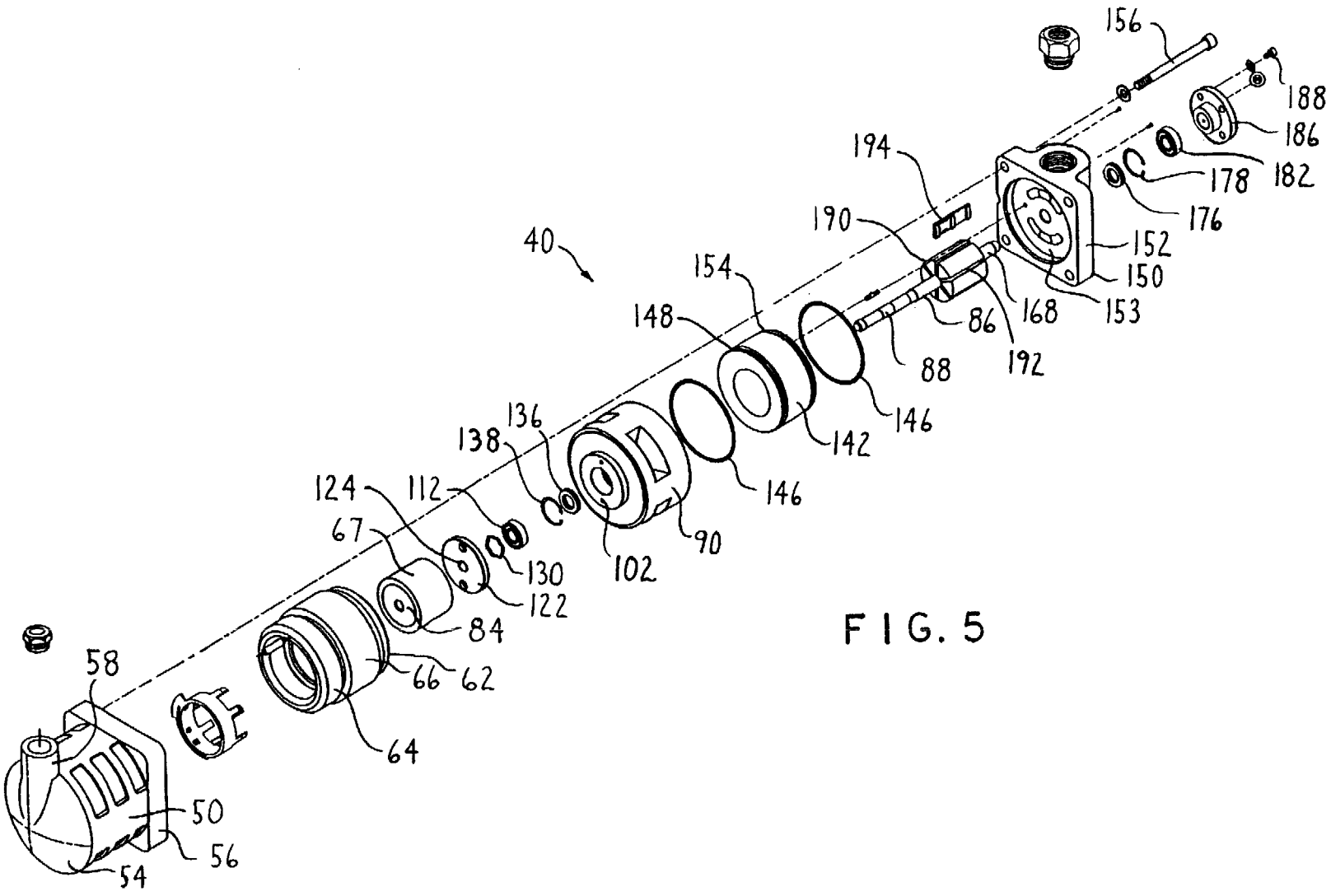
FIG. 5 is an exploded view of the vapor pump of this invention.
Figure 6:
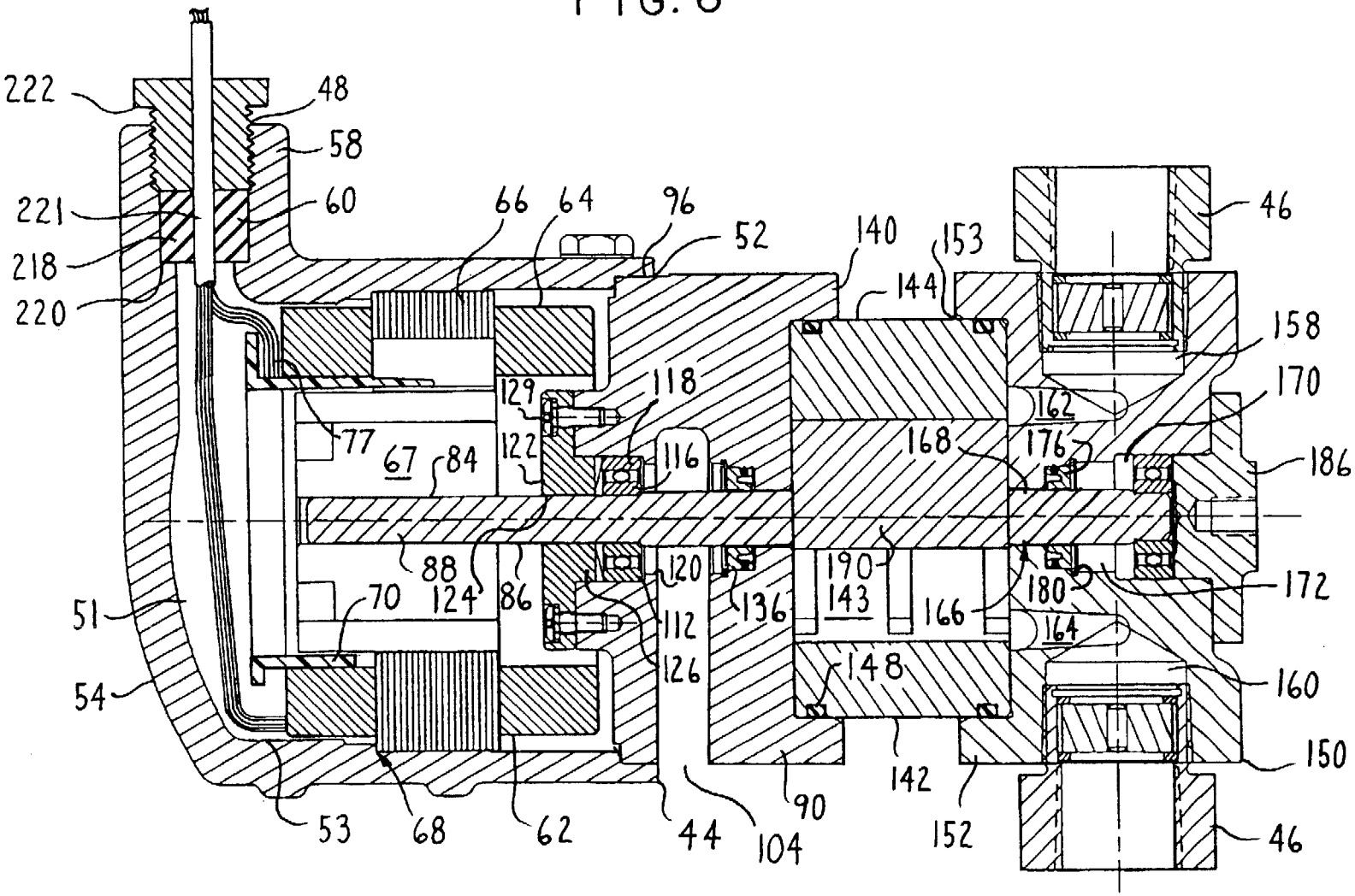
FIG. 6 is a sectional view of the vapor pump of this invention taken to show a radial opening in the inboard head.

FIGS. 4–6 illustrate a vapor recovery pump 40 constructed according to this invention. Pump 40 includes a pump unit 42 in which a suction is formed for drawing the vapor from one location so that it can be exhausted towards a second location. Motive power for energizing the pump unit 42 comes from a motor assembly 44 integrally connected to the pump unit. As discussed hereinafter, pump unit 42 is provided with an intake port and an outlet port to which separate flame arrestor assemblies 46 are attached. A gland assembly 48 integrally formed with the rear end of the motor assembly 44 forms a seal around the conductive wires over which energizeration voltages are applied to the motor assembly and the state of the motor assembly is monitored.

Motor assembly 44 includes a generally cylindrical motor housing 50 that defines a motor chamber 51. A motor housing 50 has an open end 52 directed towards pump unit 42 and an opposed closed end 54. A generally rectangular flange 56 is formed integrally with the housing 50 around the open end 52 so as to facilitate the assembly of the pump unit 44 and motor assembly into a single unit. The motor housing 50 is further formed to have a generally cylindrical boss 58 that is located adjacent closed end 54 that extends perpendicularly away from the axis of the housing. Boss 58 formed with a center bore 60 through which the electrical conductors that are attached to the motor extend. As will be described hereinafter, boss 58 forms part of the sealing gland assembly 48 that provides an explosion proof barrier around the conductors. In some preferred versions of the invention, motor housing 50 is formed to define a motor chamber 51 that has a depth of approximately 4 inches and a diameter of approximately 3.75 inches.

A cylindrical motor stator 62 is fitted in the motor housing chamber 51 so as to be located against the inside wall 53 of the motor housing 50 that defines chamber 51. Stator 62 has three individual wire windings 64. A lamination stack 66 formed of a set of flat, stacked plates of ferrous metal is disposed around the windings 64. The inside wall of the housing is formed with an annular inwardly directed step 68 against which one end of the lamination stack 66 is seated. An adhesive is used to secure the limitation stack 66 to the housing inside wall 53 so as to secure the stator 62 in the housing. As seen best by FIG. 6, step 68 is positioned so that the stator 62 is spaced a small distance away from the closed end of the motor housing 50. A magnetized, cylindrically shaped motor rotor 67 is fitted in the motor housing 50 so as to be positioned inside of the stator 62.

In many preferred versions of this invention, motor assembly 44 is a three-phase pulse DC motor. Wire windings 64 form three separate windings each of which extends the length of the stator and each of which is configured to be selectively energizable. A control circuit, not illustrated and not part of this invention, selectively energizes each winding 64 based on the pole positions of rotor 67 in order to cause the rotation of the rotor.

Figure 9:
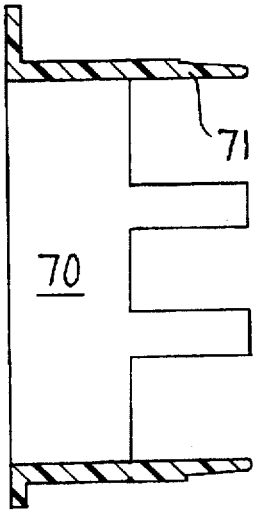
FIG. 9 is a cross sectional view of the sensor sleeve of FIG. 7.
Figure 8:
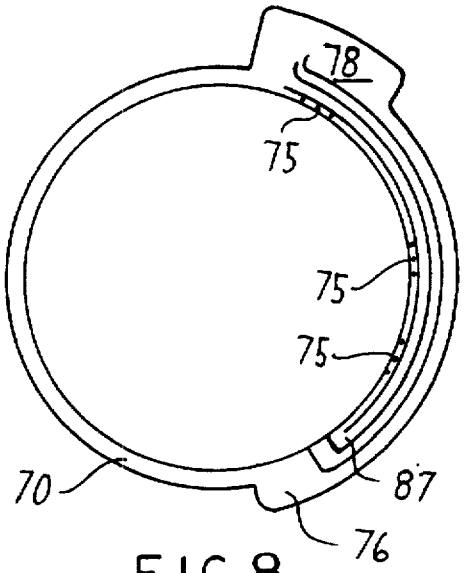
FIG. 8 is a plan view of the sensor sleeve of FIG. 7.
Figure 7:
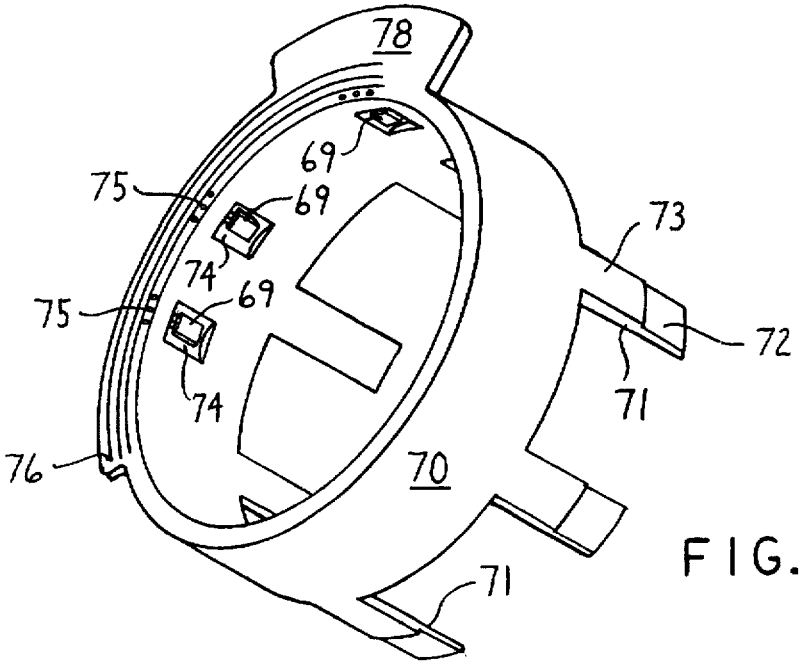
FIG. 7 is a perspective view of the sensor sleeve of this invention.

The control circuit monitors the position of the rotor 67 based on signals received by three Hall effect sensors 69 located adjacent the stator 62 and now described with respect to FIGS. 7–9. The Hall effect sensors are mounted in a cylindrically shaped, plastic support sleeve 70 that fits tightly around the inside surface of the stator windings 64 adjacent the housing closed end 54. Support sleeve 70 is mounted to the stator 62 by six mounting arms 71. Arms 71 extend into complementary interstitial gaps formed in the portion of the lamination stack 66 adjacent the wire windings 64. Each mounting arm 71 is formed with an end portion 72 of narrow cross-sectional width that fits into the lamination stack interstitial gap and a wider cross-sectional width base section 73 adjacent the sleeve 70. The mounting arm base sections 73 thus serve as standoff members which facilitate the precise positioning of the sleeve 70 a selected distance away from the lamination stack 66.

The Hall effect sensors 69 are seated in notches 74 formed along the inside wall of the sleeve 70. In some preferred versions of the invention, the Hall effect sensor 69 are positioned to be 120° electrically out of phase with each other. Consequently, in these versions of the invention the sensors are thus spaced physically approximately 50° apart from each other around a 150° arc around the stator 62. Small bores 75 formed in the base of the notches 74 serve as the space in which the leads extending from the sensors 69 extend.

The leads associated with the Hall effect sensors 69 are attached to a small arcuate shaped circuit board 76 attached to the end of sleeve 70. The circuit board, 76 which is located adjacent the end of the stator 62, serves as the terminal to which the conductors 77 (FIG. 6) associated with the sensors 69 are attached. These conductors 77 are attached to a tab 78 integral with circuit board 76 that extends radially outwardly from one end of the board. In some preferred versions of the invention, conductors 77 are sandwiched between the stator 62 and the adjacent surface of the circuit board 76 and are physically secured to the circuit board.

Returning to FIGS. 5 and 6, it can be seen that the motor rotor 67 is formed with a center bore 84 from which and elongated rotor shaft 86 extends. More specifically, rotor shaft 86 is formed with a elongated, narrow diameter stem 88 the end of which is securely fitted in the motor rotor bore 84 so that motor rotor 67 and rotor shaft 86 turn in unison.

Figure 10:
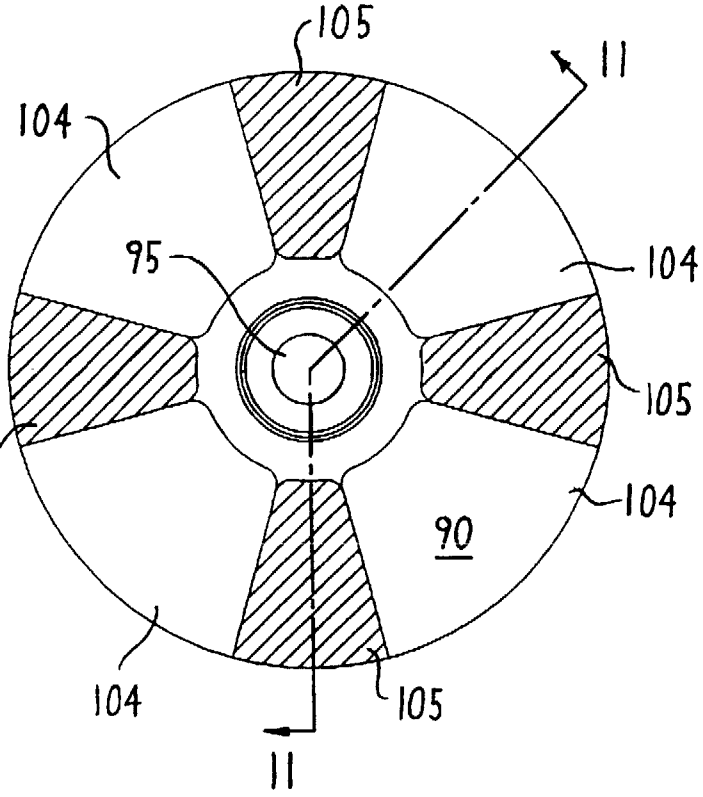
FIG. 10 is a view of the center of the inboard head of this invention.
Figure 11:
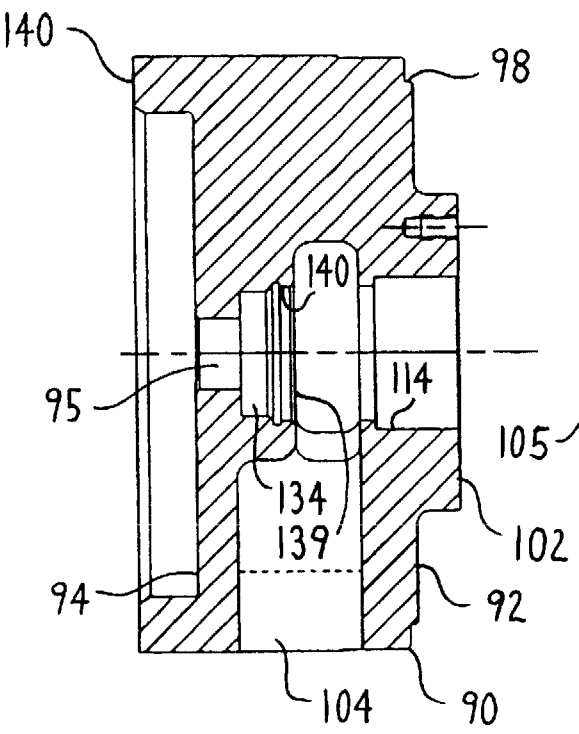
FIG. 11 is a cross sectional view of the inboard head of FIG. 10 taken along line 11—11.
Figure 12:
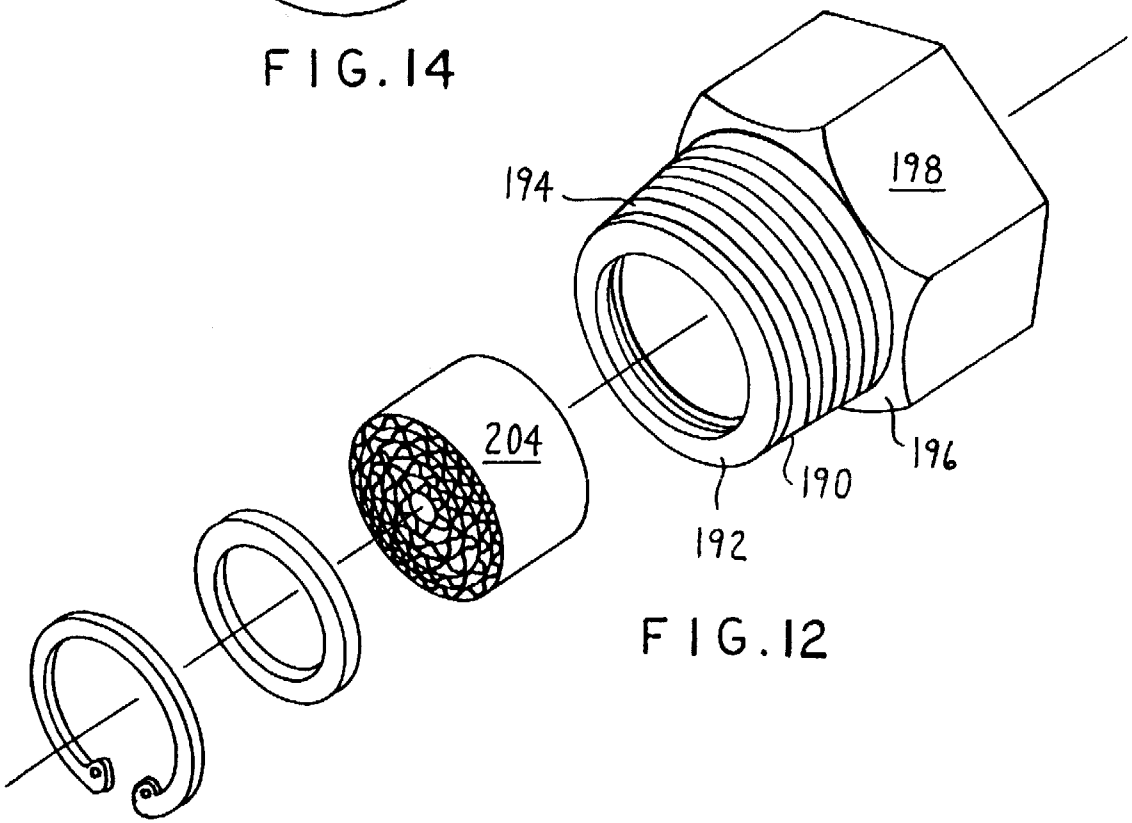
FIG. 12 is an exploded view of a flame arrestor assembly of this invention.
Figure 14:
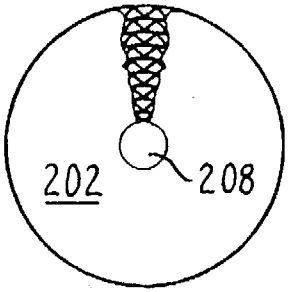
FIG. 14 is top view of the flame arrestor element.
Figure 15:
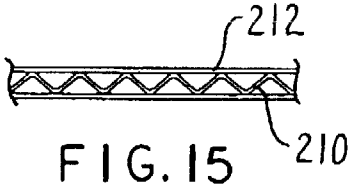
FIG. 15 is a detailed view of the web material forming the flame arrestor element.
Figure 13:
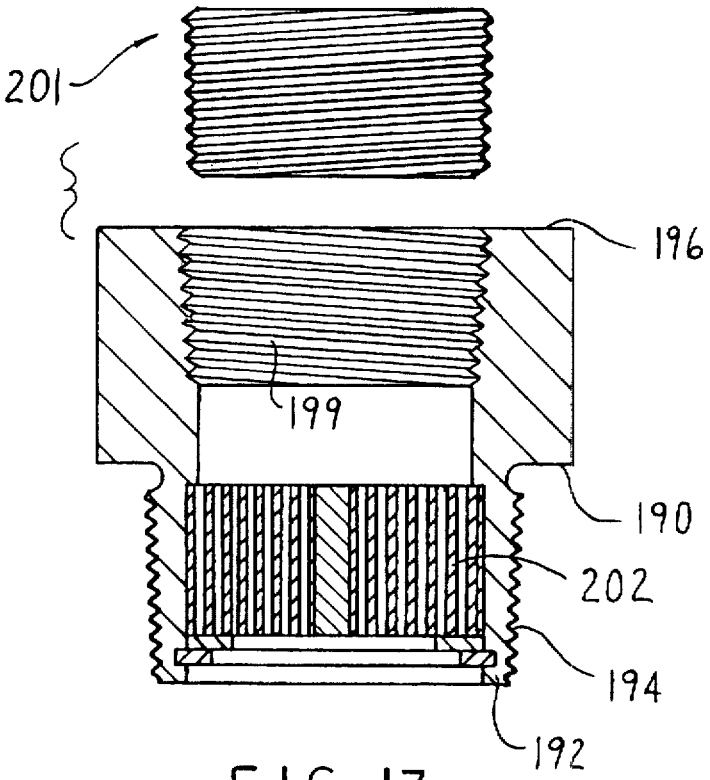
FIG. 13 is a cross sectional view of the flame arrestor assembly.

A cylindrical, single-piece inboard head 90 seals the open end 52 of the motor housing 50 and forms the base of the pump unit 42. The inboard head 90, now described by reference to FIGS. 10 and 11, includes a motor-end face 92 which is located adjacent the motor housing 50 and an opposed pump face 94 which forms the base of the pump unit 22. A center bore 95 extends axially through the inboard head 90 so as to define a space in which rotor shaft stem 88 can freely turn. Inboard head 90 is positioned so that the outer perimeter of the motor-end face 92 is seated in a counter-bore in the motor housing 50 defined by an outwardly directed step 96 in the inside wall 53 of the housing. A small step 98 is formed around the outer perimeter of the inboard head motor-end face 92 to increase the path of travel a flame would have to take out of the motor chamber 51. The motor end-face 92 is further formed to have a raised center section 102 that extends forward of the perimeter of the face towards the closed end 54 of the motor housing 50.

The inboard head 90 is further provided with four equidistantly spaced apart standoffs 105. The standoffs 105 define four arcuate-profile openings 104 that extend outwardly from center bore 95. Inboard head 90 is further formed so that the surfaces thereof that define the base of the openings 104 adjacent motor housing 50 are aligned with the top surface of the housing flange 56. In some preferred versions of the invention, standoffs 105 and openings 104 provide between 6 and 15 mm of separation between the pump unit 42 and the motor assembly 44. In more preferred versions of the invention, standoffs 105 and openings 104 provide approximately 10 mm separation between the pump unit 42 and the motor assembly 44.

The rotor shaft 86 is rotatably secured in the inboard head 90 by a bearing assembly 112 (FIG. 5). The bearing assembly is fitted in a first counterbore 114 formed in the inboard head 90 located inwardly from the motor-end face of the inboard head. Bearing assembly 112 has an inner race 116 that is compression secured to the rotor shaft stem 88 and an outer race 118 fitted against the surface of the inboard head 90 that defines the counterbore 114. The end of the bearing assembly outer race 118 that is directed towards the pump unit is disposed around an inwardly directed annular lip 120 formed as part of the inboard head 90.

Bearing assembly 112 is held in counterbore 114 by a circular motor end cap 122 secured to the inboard head raised center section 102. The end cap 122 is formed with a bore 124 through which the rotor shaft stem 88 extends. The end cap 122 is secured to the inboard head by a set of threaded fasteners 129. The end cap 122 is formed with an inwardly directed center head 126 that extends into inboard head counterbore 114. Bore 124 extends through the cap center head 122. The bore 124 is dimensioned so that the rotor shaft 86 can freely turn in the bore. The cap center head 122 and bore 124 are dimensioned to have sufficient thickness so that if there is any ignition of combustible material in the motor housing 50, flames traveling along the interstitial ring-like space between the rotor shaft 86 and the outside of the bore will be cooled so as to not ignite any gases or combustibles outside of housing 50.

A wave spring 130 is located in the counterbore 114 between the end cap 122 and the bearing assembly 112. When the end cap 122 is secured to the inboard head 90, the wave spring urges bearing assembly 112 toward the pump unit end of the assembly 40. Since rotor shaft 86 is secured to the bearing assembly and motor rotor 67 is secured to the rotor shaft 86, the action of wave spring 130 displaces both motor rotor 67 and rotor shaft 86 towards pump unit 42.

Inboard head 90 is formed with a second counterbore 134 which is in fluid communication with the openings 104 and located towards pump face 94. A lip seal 136 is fitted in counterbore 134 to form a fluid tight barrier between the rotor shaft stem 88 and the inboard head 90. Lip seal 136 is secured in position by an O-ring, (not illustrated), that extends between the lip seal and the adjacent inner surface of the inboard head 90 so as to prevent the lip seal from rotating. A lock ring 138 that is fitted into an annular groove 139 that extends around counterbore 134 to limit axial movement of the lip seal 136.

The pump face 94 of inboard head 90 is formed to have an annular lip 140 around the outer perimeter thereof that extends outwardly away from the motor housing 50. As will be discussed hereinafter, the portion of inboard head pump face 94 located inside of the annular lip 140 forms the bottom surface of a pump chamber in which the vapor-displacing suction is developed.

From FIGS. 5 and 6, it can be seen that the pump unit 42 includes a sleeve-like pump cylinder 142 one end of which is fitted against the inboard head pump face 94. Cylinder 142 is dimensioned to have an outer surface 144 which fits tightly against the adjacent surface of inboard head lip 140. A first O-ring seal 146 seated in a groove 148 formed around the outside of the cylinder forms a gas tight barrier between the inboard head and the cylinder. The inside of the pump cylinder 142 forms the actual pump chamber 143. In some preferred versions of the invention, cylinder 142 is dimensioned to define a pump chamber 143 having a length of approximately 2 inches and a diameter of approximately 2 inches.

An outboard head 150 is secured over the opposed end of pump cylinder 142. Outboard head 150 includes an generally rectangular base section 152 that defines a center-located circular socket 153 into which the adjacent end of the pump cylinder 142 is seated. A second O-ring seal 146 fitted in a groove 154 formed around the outside of cylinder 142 forms a gas tight barrier between the cylinder and the adjacent outboard head base section 150. Elongated threaded fasteners 156 that extend from the corners of the outboard head base section 152 to the motor housing flange 56. Fasteners 156 hold the pump unit 42, the inboard head 90 and motor assembly 44 together.

Outboard head 150 is formed with opposed inlet and outlet ports 158 and 160, respectively. The ports 158 and 160 are each in fluid communication with separate passageways 162 and 164, respectively, that open into the pump chamber 143. Outboard head 150 is further formed with a center bore 166 through which a head stem 168 of the rotor shaft 86 extends. A first, relatively wide diameter counter bore 170 is formed around the center bore 166 adjacent the top end of the outboard head 150. A second, smaller diameter counterbore 172 is in communication with the first counterbore 170 and is located immediately below the first counterbore 170 relative to the top of the outboard head 150.

A lip seal 176 is seated in the outboard head second counterbore 172 so as to form a gas-tight barrier between the rotor shaft 86 and the outboard head. Seal 176 is held in position by a clip ring 178 that is seated in a groove 180 formed in the outboard head around counterbore 172. An O-ring, (not illustrated,) positioned between the seal 176 and the wall defining counterbore 172 compression secures the seal in place to prevent it from rotating. A bearing assembly 182 rotatably secures the tip end of the rotor shaft 86 to the outboard head 150. Bearing assembly 182 has an outer race which is fitting against the annular surface of the outboard head 150 that defines the first counterbore 170. The bearing assembly 182 has an inner race that is fitted against the pump rotor head stem 168. Counterbore 170 is covered by a outboard head cap 186 that is fitted over the top of the outboard head 150. Cap 186 is secured to the outboard head 150 by threaded fasteners 188.

Rotor shaft 86 has a relatively large diameter pump rotor head 190 integral with rotor shaft stem 86 that is located in pump chamber 143. Pump rotor head 190 is formed to define a number of slots 192 that extend radially outwardly from the center axis of the rotor shaft 86. A vane 194 is slidably fitted in each slot 192. As the rotor shaft 86 turns, the vanes 194 slide in and out of the slots 192 so as to define small chambers of cyclically increasing and decreasing volume. As the volume of an individual sub-chamber increases, the chamber draws a vacuum. It is at this point the chamber is in fluid communication with the inlet port so that vapor can be drawn into the pump unit 42. As the rotor continues to turn, the volume of a chamber decreases. Consequently, the fluid in the chamber is forced outwardly through the exhaust port 160.

Each flame arrestor assembly 46, as seen in FIGS. 12–15, has a generally sleeve-like body 190 formed of brass or steel. The body 190 has a lower, relatively narrow diameter base section 192 that is fitted in the complementary outboard head port 158 or 160. The outer surface of body base section is formed with threading 194 to facilitate securing the body to complementary threading, not identified, formed around the adjacent port 158 or 160. Integral and concentric with body base section 192 is an outer body 196. The outer surface of outer body 196 is formed to define a multi-faced surface 198 in order to facilitate the installation and removal of the flame arrestor 46. The inner surface of the outer body 198 is formed with threading 199 to accommodate the coupling of a complementary male threaded vapor line 201 thereto.

Located inside the body base section 192 is cylindrically shaped flame arrestor element 202 formed of steel or other material that has a relatively high thermal conductivity. In the depicted version of the invention flame arrestor element 202 has a solid, sleeve-like outer shell 204 in which a flame arresting foil 206 is wound around a solid core 208. The foil comprises a wavy sheet 210 of material that is wound around a flat sheet 212 of like material.

The gland assembly 48 (FIG. 6) functions as a vapor tight seal around the conductors which extend into the motor housing for supplying energization currents to the motor and that provide conductive path for the sensor signals that are monitored to determine motor state. The gland assembly includes a sleeve-like gland element 218 formed of compressible material such as rubber or silicon that is seated inside motor housing boss bore 60. More specifically, gland element 218 is seated around a ring like step 220 formed in the boss 58 that restricts further movement of the gland element. The gland element 218 is formed with a center located bore 221 through which the conductors connected to the motor extend.

The gland element 218 is held in position by a tubular gland fitting 222 that is threadedly secured in boss bore 58. The fitting 222 actually abuts against the top of the gland element 218. When the fitting is coupled to the motor housing 50, the fitting is tightened down over the gland element 218 to cause the element to collapse inward over gland bore 220. The closing of bore 222 around the conductors thus serves to provide a vapor tight seal around the conductors.

When the vapor recovery pump 40 of this invention is being assembled, the Hall effect sensors 69 are housed securely in the associated sleeve 70. The sleeve 70, is itself, held off from the lamination stack 66 a fixed distance by the mounting arms 71. Consequently, when the motor rotor 67 is placed in the motor housing 50, the likelihood that the rotor will inadvertently abut against the sensors is substantially eliminated. Moreover, since the sensors 69 are seated in the notches 74 formed in the sleeve 70, during shipping or at other times the position of the rotor is disturbed, to the extent that the rotor abuts the sensors, the sensors will remain held in place by the sleeve. Thus, this feature of the invention eliminates the possibility that inadvertent movement of the rotor will damage the Hall sensors. Moreover, the sleeves and associated lamination-stack directed stand off arms eliminate the need to have any portion of the sensor mounting assembly extend more than 0.4 inches from the end of the stator 62. This feature of the invention makes it possible to have a relatively small spacing between the end of the stator 62 and the adjacent end of the motor housing 52. Thus sleeve 70 serves to substantially reduce the number of pumps 40 of this invention that are either defectively assembled or delivered in a damaged state.

Still another feature of this invention is that inboard head 90 is a single, compact unit that both serves as the top of the motor assembly 44 and the base of the pump unit 42. Moreover, the inboard head, in addition to performing these mechanical functions, separates the motor assembly 44 from the pump unit 42. If there is ignition in either the motor chamber 51 or pump chamber 143, any gases of combustion that are discharged from through the inboard head will be vented through the openings 104. Thus the possibility that the gases of combustion could potentially be transferred to the complementary sub-assembly forming the pump 40 of this invention is substantially eliminated.

Still another feature of this invention is that the flame arrestor assemblies 46 are not built into the pump unit 42. Instead, these assemblies 46 are attached to the outside of the pump unit 42. Thus, it is a relatively simple task to remove and replace the flame arrestor element 202 by simply unscrewing the associated vapor line from the body 190 in which the element is housed and then unscrewing the flame arrestor body 190 from the outboard head 150. Moreover, the flame arrestor assemblies 46 are contained entirely within the assembly bodies 190. Thus, by removing an assembly body 190 from the pump 40 to which the body 190 is attached, one quickly gain access to the other components of the assembly. This further simplifies the efforts required to remove and replace the flame arrestor elements 202.

Moreover, since the gland assembly 48 is built into the motor housing 50, the overall length of the portion of the pump formed along the housing boss 58 is reduced.

Thus, the pump 40 of this invention does more than simply serve as an efficient means for drawing the suction needed to draw vapor from a first location so that it can be exhausted to a second location. The pump 40, in addition to performing this function, has a pump unit 42 and a motor unit 44 that are both explosion proof. Moreover, the pump unit and motor unit 44 are spaced a relatively wide distance apart from each other so as to minimize the likelihood that any damage or combustion in one assembly will be the cause of damage to the other assembly. At the same time the pump 40 has these capabilities, it is of the same overall size, from bottom of the motor housing 50 to the top of the end cap 186, approximately 9 inches, as the pumps that preceded it.

The foregoing has described specific embodiments of this invention. It will be apparent, however, from the foregoing that aspects of the invention can be practiced using alternative components than what have been described. For example, the dimensions given are those for constructing a pump of one particular size. It should be clear from the detailed described that pumps of smaller and larger size can be constructed that incorporate the features of this invention. Furthermore, while the described pump includes a DC-pulse driven motor, it should be clear that in other versions of the invention alternative motors may be employed to provide the motive power needed to energize the pump unit. Similarly, in still other versions of the invention, the pump unit 42 may incorporate other elements for forming the vacuum that serves as the suction/exhaust force. Moreover, while in the disclosed version of the invention, the sleeve 70 in which the sensors 69 that monitor the motor state are described as being secured to the motor stator 62, that need not always be the case. In some versions of this invention, it may be desirable to mount the sleeve directly to the motor housing 50.

Thus, although a particular preferred embodiment of the invention has been disclosed for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A vapor pump for attachment to a vapor return line, said vapor pump including:

a pump unit, said pump unit having a pump cylinder with opposed open ends and that defines a pump chamber in which a vacuum is drawn and an outboard head seated over a first end of said pump cylinder, said outboard head being formed with an inlet port through which vapor is drawn into said pump chamber and an outlet port through which vapor is discharged from said pump chamber;

a flame arrestor assembly, said flame arrestor assembly releasably attached to one of said ports in said outboard head of said pump unit and including: a body releasably attached to said port, said body having a center opening extending therethrough; a coupling member integral with said body for receiving the vapor return line; and a flame arrestor releasably secured in said center opening of said body;

a motor assembly including a motor housing attached to said pump unit and a motor disposed in said motor housing for supplying a motive force to said pump unit;

a single-piece rotor shaft extending between said motor and said pump cylinder for transferring the motive power developed by said motor to said pump unit; and an inboard head fitted over a second end of said pump cylinder for sealing said pump chamber and over said motor housing for sealing said motor housing, said inboard head being dimensioned to space said pump cylinder and said motor housing apart from each other, to define a rotor bore in which said rotor shaft is disposed so as to allow for rotation of said rotor shaft and to define at least one opening that extends between said rotor bore and an outer surface of said inboard head located between said pump unit and said motor housing.

2. The vapor pump of claim 1, wherein said flame arrestor assembly is releasably attached to said inlet port formed in said outboard head of said pump unit.

3. The vapor pump of claim 1, wherein said flame arrestor assembly is releasably attached to said outlet port formed in said outboard head of said pump unit.

4. The vapor pump of claim 1, wherein said coupling member of said flame arrestor assembly comprises a section of said body of said flame arrestor assembly formed with threading for receiving a complementarily threaded vapor return line.

5. The vapor pump of claim 1, wherein:

a plurality of conductors extend from said motor for controlling the energization of said motor;

and said motor housing includes a gland assembly for providing a sealed conduit for said motor conductors, said gland assembly including, a bore formed in said motor housing, a compressible gland element seated in said motor housing bore, said gland element being formed with a center bore through which said motor conductors extend, and a fitting releasably secured to said motor housing bore, said fitting being positioned to bear against said gland element so that when said fitting is secured in said motor housing bore, said fitting causes said gland element to compress inwardly so that said gland element center bore seals around said motor conductors.

6. The vapor pump of claim 1, wherein: said inboard head is a single piece unit; a bearing assembly is seated in said inboard head to rotatably couple said rotor shaft to said inboard head; and a end cap is fitted over said inboard head so as to be disposed in said motor housing and is positioned to cover said inboard head bearing assembly.

* * * * *